US006681956B2

(12) United States Patent
Bolgar

(10) Patent No.: US 6,681,956 B2
(45) Date of Patent: Jan. 27, 2004

(54) DRUM ASSEMBLY FOR DISPENSING A PLURALITY OF FLUIDS

(76) Inventor: José Beltrán Bolgar, Perón 1219-3° "14" , Ciudad de Buenos Aires (AR), 1038

( * ) Notice: Subject to any disclaimer, the term of this patent is extended or adjusted under 35 U.S.C. 154(b) by 0 days.

(21) Appl. No.: 10/039,698

(22) Filed: Oct. 19, 2001

(65) Prior Publication Data

US 2002/0096538 A1 Jul. 25, 2002

(30) Foreign Application Priority Data

Jan. 19, 2001 (AR) ..... 100249

(51) Int. Cl.[7] ..... A67D 5/56

(52) U.S. Cl. ..... 222/129; 222/321.9; 222/465.1; 222/509; 220/23.8; 220/506; 220/555

(58) Field of Search ..... 222/129, 465.1, 222/383.1, 321.9, 181.2, 489, 509; 220/503, 505, 555, 567, 565, 23.8, 636, 506

(56) References Cited

U.S. PATENT DOCUMENTS

| | | | | | |
|---|---|---|---|---|---|
| 3,698,551 | A | * | 10/1972 | Tomlinson | 206/80 R |
| 3,987,932 | A | * | 10/1976 | Maldon | 221/96 |
| 4,032,047 | A | | 6/1977 | Wilson | 222/183 |
| 4,139,124 | A | | 2/1979 | Ferrante | 222/110 |
| 4,143,795 | A | * | 3/1979 | Casebier | 222/143 |
| 4,491,245 | A | | 1/1985 | Jamison | 222/107 |
| 4,550,854 | A | * | 11/1985 | Schellenberg | 220/468 |
| 4,616,759 | A | | 10/1986 | Mahler | 215/228 |
| 4,640,441 | A | | 2/1987 | Bunschoten | 222/207 |
| 4,715,279 | A | | 12/1987 | Albanese | 101/148 |
| 4,886,176 | A | * | 12/1989 | Steakley | 215/229 |
| 4,932,563 | A | * | 6/1990 | Diamond et al. | 222/129 |
| 4,950,083 | A | * | 8/1990 | Bavaveas | 366/348 |
| 5,085,346 | A | * | 2/1992 | Wright | 222/143 |
| 5,183,182 | A | * | 2/1993 | Comstock et al. | 222/129 |
| 5,303,852 | A | | 4/1994 | Yamawaki et al. | 222/209 |
| 5,413,251 | A | * | 5/1995 | Adamson | 222/129 |
| 5,673,817 | A | * | 10/1997 | Mullen et al. | 222/94 |
| 5,842,609 | A | | 12/1998 | Higgins et al. | 222/181.3 |
| 5,868,287 | A | | 2/1999 | Kurokawa et al. | 222/380 |
| 6,010,034 | A | * | 1/2000 | Walthers | 222/135 |
| 6,439,757 | B2 | * | 8/2002 | Lloyd | 366/130 |

* cited by examiner

*Primary Examiner*—Gene Mancene
*Assistant Examiner*—Frederick C. Nicolas
(74) *Attorney, Agent, or Firm*—Emrich & Dithmar

(57) ABSTRACT

The drum assembly of the present claimed invention is used for washing and is comprised of a primary container and a supplementary container integral as a single structure. The primary container may be filled with water and the supplementary container may be filled with any cleansing substance, for example, detergent. The primary container includes a support base and a flattened body of the handle for the mounting or support of the drum where toilet assemblies are not available, such as in trucks, motor vehicles, camping facilities, and any other suitable location.

14 Claims, 3 Drawing Sheets

DRUM ASSEMBLY FOR DISPENSING A PLURALITY OF FLUIDS

BACKGROUND OF THE INVENTION

The present invention relates to a portable container assembly and, in particular, to a primary container drum having a supplementary or secondary container attached thereto. The primary container is adapted to receive a first fluid and the secondary container is adapted to received and dispense a second fluid. The container assembly is intended for washing and is suitable for being conveyed in vehicles.

At present, known drums are mounted to the side of a truck or any other type of motor vehicle. Such drums are cylindrically shaped and provide a single hollow container chamber having no other supplementary container built into it, where cleansing products, such as liquid soap or detergent, may be stored and dispensed.

Also, because such drums do not feature any handle or flange, it is difficult for the drum to be securely attached to a vehicle; thus, in most cases, a strap or hoop is necessary to attach the drum to a vehicle. Specifically, it has been observed that truck drivers attach a conventional single plastic or metal drum to the sides of a truck, with the drum furnished with a spigot for water dispensing, either for drinking or washing purposes. Accordingly, a container filled with a cleansing liquid or detergent is a separate member, generally loosely placed in a cab or in a toolbox.

Because this container structure requires two separate storage members, often times the user does not achieve proper hygiene during usage because it is not an uncommon situation that the cleaning container is lost or neglectfully becomes disassociated from the container structure.

SUMMARY OF THE INVENTION

The present invention relates to a drum assembly for dispensing a plurality of fluids. The drum assembly includes a container furnished with a liquid dispenser, which, in a single plastic structure, includes a primary container adapted to receive a first liquid, with the primary container having an upper loading opening and a lower discharge opening. A secondary container is provided with a liquid dispenser, with the secondary container adapted to receive a second liquid. The secondary container is attached and secured to the primary container. The supplementary or secondary container is used for storage of cleansing liquids such as soaps and detergents and is provided with a dispensing device.

In order to overcome the drawbacks and problems of the prior art, the present invention is a drum assembly comprised of a primary container member and a smaller container member attached, preferably, to the front surface thereof which may be filled with detergent or with any other liquid used for cleansing.

The drum assembly is shaped so that it may be hand-carried or tightly secured over its bottom base member or fixed with bolts to a given support. Also, secured to a side of the primary drum is the secondary container. The secondary container includes a liquid dispensing pump which is tightly mounted, preferably it is screwed, to the secondary container so that it may be removed whenever the detergent or other liquid requires to be replaced or refilled. The dispensing pump may be actuated by pressing with the back of a hand or by a finger. Additionally, the primary container or drum includes a first opening in the upper portion of the drum. The upper opening may be closed with a removable lid member. A second opening is located on the lower portion of the drum. The lower opening is structurally arranged to receive a lid or cover having a water outlet valve member which is mounted therein. The valve member may be a standard, conventional spigot member. The positioning of the lid member on the lower opening permits for easy access for quick cleaning of the drum, as desired.

DESCRIPTION OF THE DRAWINGS

For the purposes of facilitating an understanding of the present invention, there is illustrated in the accompanying drawings a preferred embodiment thereof, from an inspection of which, when considered in connection with the following description, the invention, its construction and operation and many of its advantages will be readily understood and appreciated.

DETAILED DESCRIPTION

Figure 1:
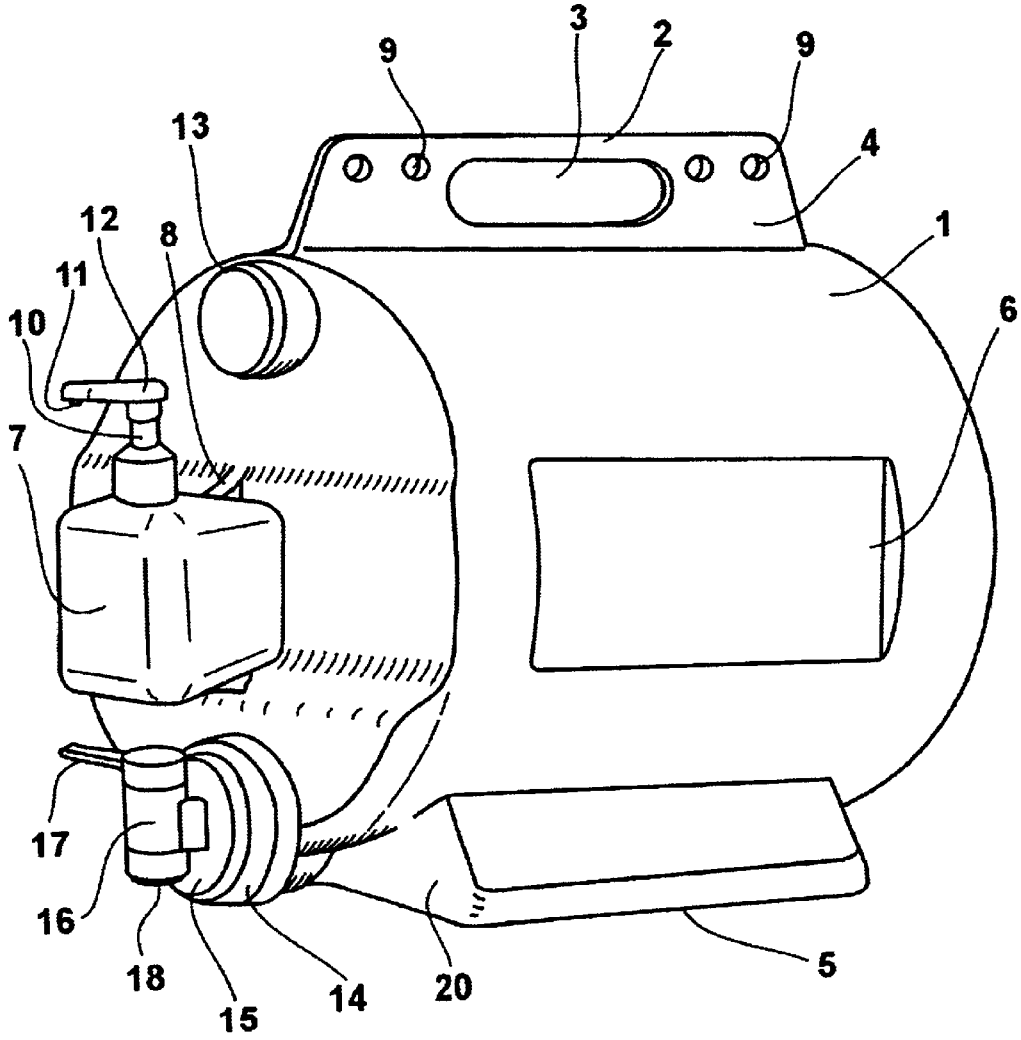
FIG. 1 is a perspective view of the drum assembly in accordance with the present invention.

Referring now to the drawings wherein like numerals have been used throughout the several views to designate the same or similar parts, in FIG. 1 a drum assembly in accordance with the present invent on is illustrated. As shown in FIG. 1, the drum assembly is comprised of the large volume primary container, which on the upper portion thereof includes a flattened projection 4 extending outwardly therefrom, which provides a handle 2 for the assembly. The handle 2 is formed by wide opening or hollow 3 which is structurally arranged to receive the fingers of a hand for either manipulation or conveyance.

The flattened projection 4 is furnished with openings 9 which permit the drum assembly to be fixed by means of bolts or screws to a suitable support, thus complementing the resting position over the drum's bottom base 5. The bottom base 5 is an extension of the primary container 1. Sidewalls 6 of the primary container 1 serve a double purpose. The walls are a structural reinforcement on the side of the container and the walls may be a location for placing advertising or ornamental elements thereon.

Figure 2:
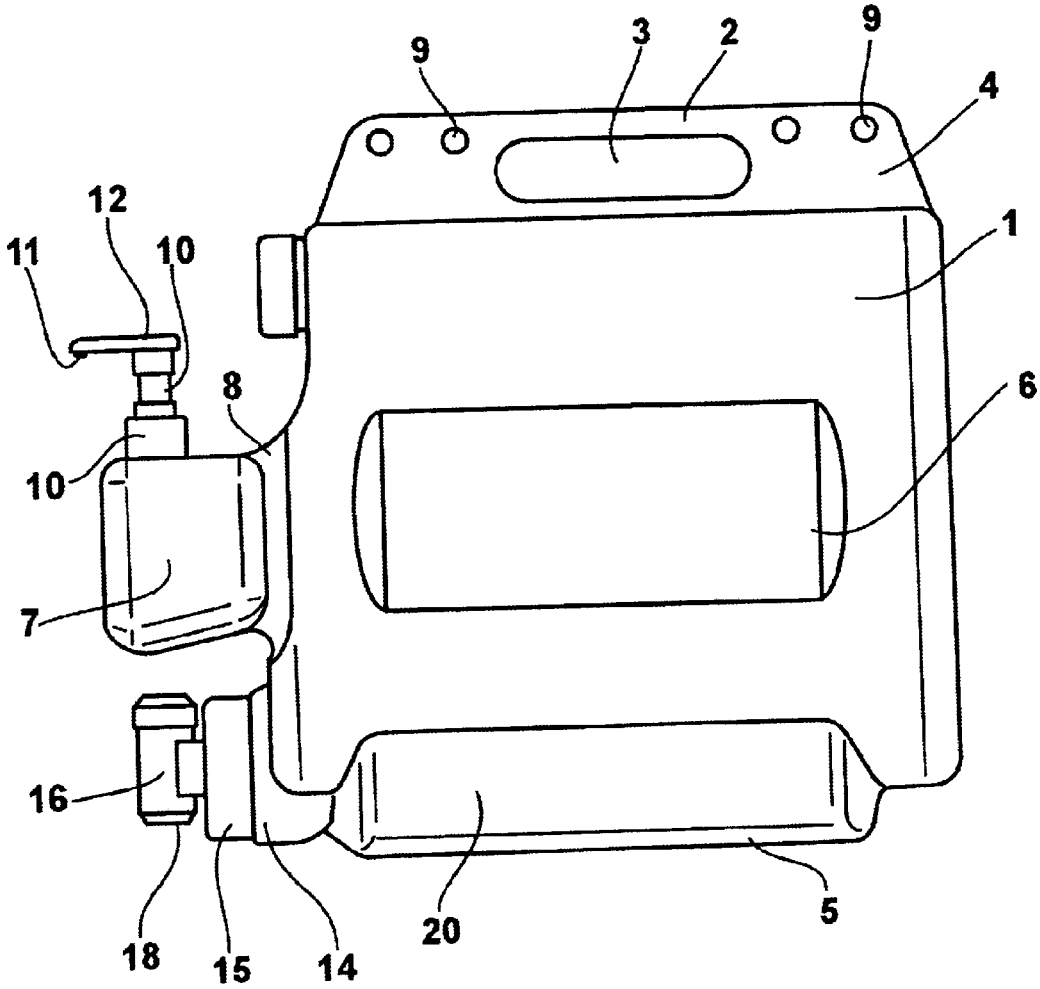
FIG. 2 is a side view of the drum assembly in accordance with the present invention.

On the front section or facing 21 of the drum or container 1 there is a smaller container 7 which is attached and secured to the main container 1 of the drum through a flattening or support 8 which divides and spaces apart the drum compartment 1 from the supplementary container compartment 7, as is shown in FIG. 2. Mounted on the supplementary container 7 is a pump 10 having a spout 11. A portion of detergent or cleaner comes from the spout 11 when the handle 12 is pressed and the pump is actuated.

Also shown in FIG. 2, the lid 22 covers the upper opening 13, through which the primary container 1 may be filled with liquid, in most cases potable water. Located on the lower portion of the drum is a lower opening 14. The lower opening 14 is preferably wider than the upper opening so that the drum 1 maybe cleaned without difficulty. Opening 14 is covered by a screwed lid 15, wherein a spigot 16 is mounted, having a handle or lever 17. The movement of lever 17 opens and closes the spigot which permits and controls the liquid outflow. Outlet member 18 projects from spout 16 of the front of the drum and is located below the supplementary container 7. The spout 16 is mounted on the lid member 15 which is located on the projecting lower opening 14 located on the front surface 21 of the drum 1. In this embodiment of the present invention, the spigot 16 may be directly mounted over the smaller projecting lower opening in the lid and screwed thereto. The spigot 16 maybe adapted in shape and size for this purpose in said lower front surface 21 or any other region of the drum. The supplementary container 7 may also be furnished with a small spigot in the lower portion thereof, with a lid in the upper portion thereof, if desired.

In FIG. 2, a flattening or support 8 is provided during the manufacturing process. The process may be compression formed during the plastic blowing process. The support 8 spaces apart the supplementary container 7 from the primary container 1 of the drum. As shown in FIG. 2, the supplementary container 7 demonstrates one arrangement of mounting the dispensing pump 10, the pour-spout 11 and the handle 12 thereto. Also shown in FIG. 2 is the arrangement of base portion 5 in relation to the drum or container 1.

Figure 3:
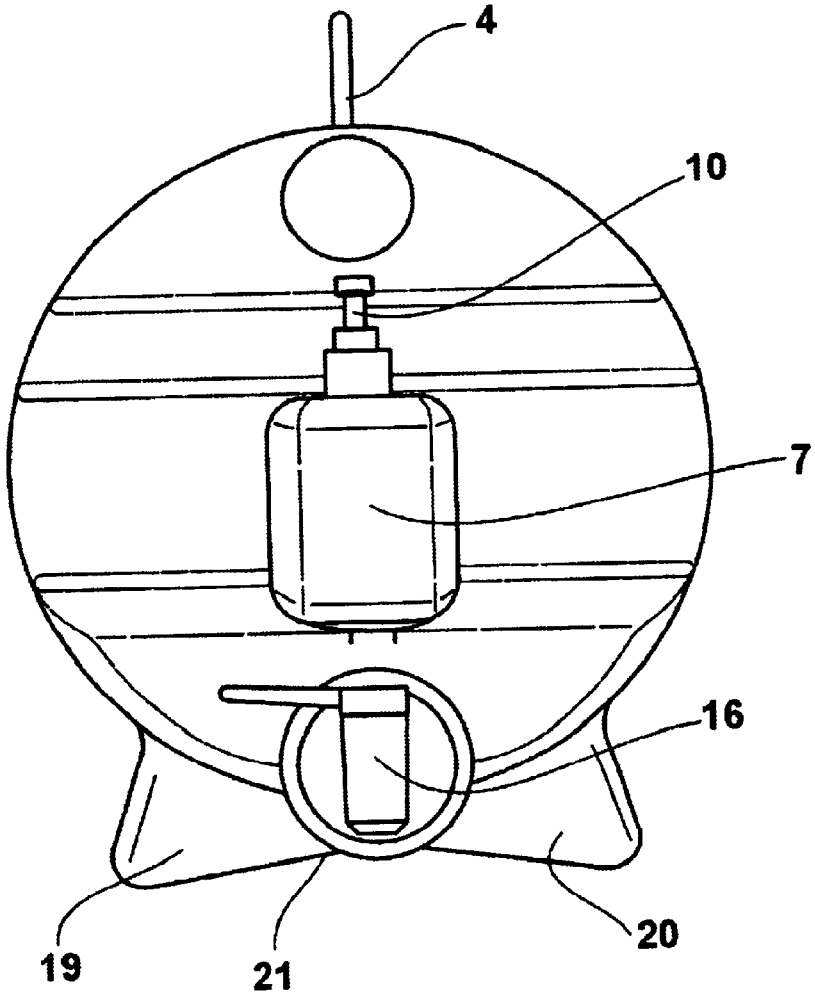
FIG. 3 is a front view of the drum assembly in accordance with the present invention.

FIG. 3 illustrates the substantially symmetrical bosses 19 and 20 which possess a slight concave depression 21 to form the base portion 5. The bottom base member portion 5 of said bosses 19 and 20 insure the co-planar supporting means to achieve stability of the drum. The bosses 19 and 20 may be larger or smaller in accordance with the intended use or practice.

The flattened body 4 of the handle is positioned upon the upper part of the drum as shown in FIG. 3. In the various embodiments shown, the volume, size and shape of this drum and those of the smaller container may be altered by one skilled in the art, and this alteration does not change the scope and spirit of the present invention.

I claim:

1. A drum assembly for dispensing a plurality of fluids, including in combination:

a primary water container having an upper portion, a lower portion, and a front surface with said upper portion having a loading opening therein and said lower portion having a discharge opening in the lower portion of said primary container, with said primary container structurally adapted to receive the water therein and structurally arranged to discharge the water from said discharge opening;

a secondary container having a volume which is less than said primary container, with said secondary container adapted to receive a cleaning fluid and having a discharge opening structurally arranged to receive a dispensing member for dispensing said cleaning fluid; and wherein said primary and said secondary containers are molded integrally to one another to provide an unitary drum assembly.

2. The drum assembly in accordance with claim 1, wherein said primary container includes a projection member extending outwardly therefrom, with said projection member having an opening therein to provide a handle for the drum assembly.

3. The drum assembly in accordance with claim 1, wherein said primary container inch des a projection member extending outwardly therefrom, with said projection member having at least one opening therein to provide mounting means of the drum assembly to a supporting structure.

4. The drum assembly in accordance with claim 1, wherein said secondary container is integrally mounted to said front surface of said primary container.

5. The drum assembly in accordance with claim 1, wherein said dispensing member is liquid dispensing pump.

6. The drum assembly in accordance with claim 1, wherein said dispensing member is a dispensing valve built into a spigot.

7. The drum assembly in accordance with claim 1, wherein said loading opening is positioned in the front surface of said upper portion thereof.

8. The drum assembly in accordance with claim 1, wherein said primary container includes an opening in the front surface of said lower portion thereof with said lower opening providing a mounting for a valve member having a spout for permitting discharge from said primary container.

9. The drum assembly in accordance with claim 8, wherein said primary container includes bosses on the lower portion thereof, which bosses provide a supporting base for the assembly.

10. The drum assembly in accordance with claim 9, wherein said bosses an hollow and positioned below said discharge level, so they include the water with in said primary container as a ballast for stabilization.

11. The drum assembly in accordance with claim 1, wherein the front surface of said primary container includes rib members to provide reinforcement for the drum assembly.

12. The drum assembly in accordance with claim 3 wherein said mounting means of said projection member provide attachment to a truck.

13. The drum assembly in accordance with claim 1, wherein said primary container includes an outer peripheral wall having at least one reinforcement section therein to provide reinforcement of the drum assembly.

14. The drum assembly in accordance with claim 13, wherein said at least one reinforcement section is structurally arranged to receive indicia thereon.

* * * * *